United States Patent [19]

Pugh

[11] Patent Number: 4,680,453

[45] Date of Patent: Jul. 14, 1987

[54] VEHICLE PERFORMANCE COMPUTER

[76] Inventor: R. Dell Pugh, 13622 Pine Villa La., Ft. Myers, Fla. 33912

[21] Appl. No.: 829,170

[22] Filed: Feb. 14, 1986

[51] Int. Cl.[4] ..... G06C 3/00

[52] U.S. Cl. ..... 235/88 R; 235/78 R

[58] Field of Search ..... 235/78 R, 78 N, 88 R, 235/88 N, 89 R

[56] References Cited

U.S. PATENT DOCUMENTS

| | | | |
|---|---|---|---|
| 3,569,994 | 3/1971 | Rau | 235/78 N |
| 3,640,453 | 2/1972 | Caillouet | 235/78 R |
| 3,747,845 | 7/1973 | Portuesi | 235/88 R X |
| 3,757,092 | 9/1973 | Miller | 235/88 R X |
| 3,986,002 | 10/1976 | DeMaio | 235/88 R X |
| 4,311,902 | 1/1982 | Koll | 235/78 R |
| 4,456,821 | 6/1984 | Harter | 235/89 R X |

*Primary Examiner*—Benjamin R. Fuller

*Attorney, Agent, or Firm*—Charles J. Prescott

[57] ABSTRACT

A vehicle performance computer for determining the performance parameters of a vehicle including: a substantially planer base having logarithmic scales representing speed, weight-to-horsepower, distance, and time arcuately disposed about a center; a substantially planar intermediate slide having logarithmic scales representing percent grade, speed factor, and top time and distance percent grades in proporation to the percent grade scale and arcuately disposed about a center; and a substantially planer top slide having logarithmic scales representing speed factors in relation to time and distance scales and arcuately disposed about a center. All three planer members are rotatably connected one to another coaxially about the three centers with the intermediate slide lying between the base and top slide. The intermediate scale also includes a window arcuately disposed about the center for viewing the weight-to-horsepower scale in relation to the percent grade scale. Scales on the top slide readably interact with the time and distance scales, the time and distance percent grade scales, and a brake tick mark disposed on the intermediate scale. The speed factor scale disposed on the intermediate slide also readably interacts with the speed scale. All scales may be adapted to the general size, weight and function of the class of vehicles.

13 Claims, 7 Drawing Figures

VEHICLE PERFORMANCE COMPUTER

BACKGROUND OF THE INVENTION

This invention relates generally to portable computers, and more particularly to a specific form and purpose of these portable computers for viewable use in determining performance parameters related to specific vehicles.

Many people have a both curious and a professional interest in determining the operating parameters related to the performance of specific vehicles. Accurate prediction of attainable speeds, elapsed times, and travel distance with respect to various vehicle characteristics, road grades, and vehicle speeds are desirable knowledge by both the curious and professional individuals in a wide variety of situations. However, because the physical relationships and mathematical equations are numerous and complex, applicant is unaware of any convenient, inexpensive and portable calculator for accurate determination of these variables.

Prior art discloses many such calculators for other uses:

a. U.S. Pat. No. 3,986,002 to DeMaio for a laser system computer associated with laser radar, designation, communication, and directed energy applications.

b. U.S. Pat. No. 3,747,845 to Portuesi for a computer for calculating the speed and distance traveled by bicycles.

c. U.S. Pat. No. 4,311,902 to Kool for a calculator for determining lead in shooting a projectile at a moving target.

d. U.S. Pat. No. 3,640,453 to Caillouet for a portable computer for use by motorists in calculating various quantities in the operation of an automobile.

e. U.S. Pat. No. 3,569,994 to Rau for a navigational computer for aircraft.

To the extent that these above prior art disclosures actually work, their accuracy and scope of performance is questionable at best, particularly the Caillouet reference for motorists and automobile performance prediction.

The present invention is directed to a portable computer which includes logarithmic scales arcuately disposed upon three intermoveable cooperative members for accurately producing performance characteristics of a vehicle of known physical characteristics and, alternately, providing "working back" functions for determining the physical characteristics of a vehicle based upon its performance characteristics. The present invention also provides means for empirical adjustment of input factors to more accurately predict vehicle performance.

BRIEF SUMMARY OF THE INVENTION

The present invention is directed to a vehicle performance computer for determining the performance parameters of a vehicle including: a substantially planer base having logarithmic scales representing speed, weight-to-horsepower, distance, and time arcuately disposed about a center; a substantially planer intermediate slide having logarithmic scales representing percent grade, speed factor, and top time and distance percent grades in proportion to the present grade scale and arcuately disposed about a center; and a substantially planer top slide having logarithmic scales representing speed factors in relation to time and distance scales and arcuately disposed about a center. All three planer members are rotatably connected one to another coaxially about the three centers with the intermediate slide lying between the base and top slide. The intermediate scale also includes a window arcuately disposed about the center for viewing the weight-to-horsepower scale in relation to the percent grade scale. Scales on the top slide readably interact with the time and distance scales, the time and distance percent grade scales, and a brake tick mark disposed on the intermediate scale. The speed factor scale disposed on the intermediate slide also readably interacts with the speed scale. All scales may be adapted to the general size, weight and function of the class of vehicles.

It is therefore an object of this invention to provide a portable calculator for the accurate determination of vehicle performance.

It is another object to provide the above invention adapted to each particular class of vehicles.

It is another object to provide the above invention which is adaptable to empirical data for improved accuracy.

It is yet another object to provide the above invention which is viewably readable, economical to construct, and independent of electronic means for its accurate operation.

In accordance with these and other objects which will become apparent hereinafter, the instant invention will now be described with reference to the accompanying drawings in which:

DETAILED DESCRIPTION OF THE INVENTION

Figure 1:
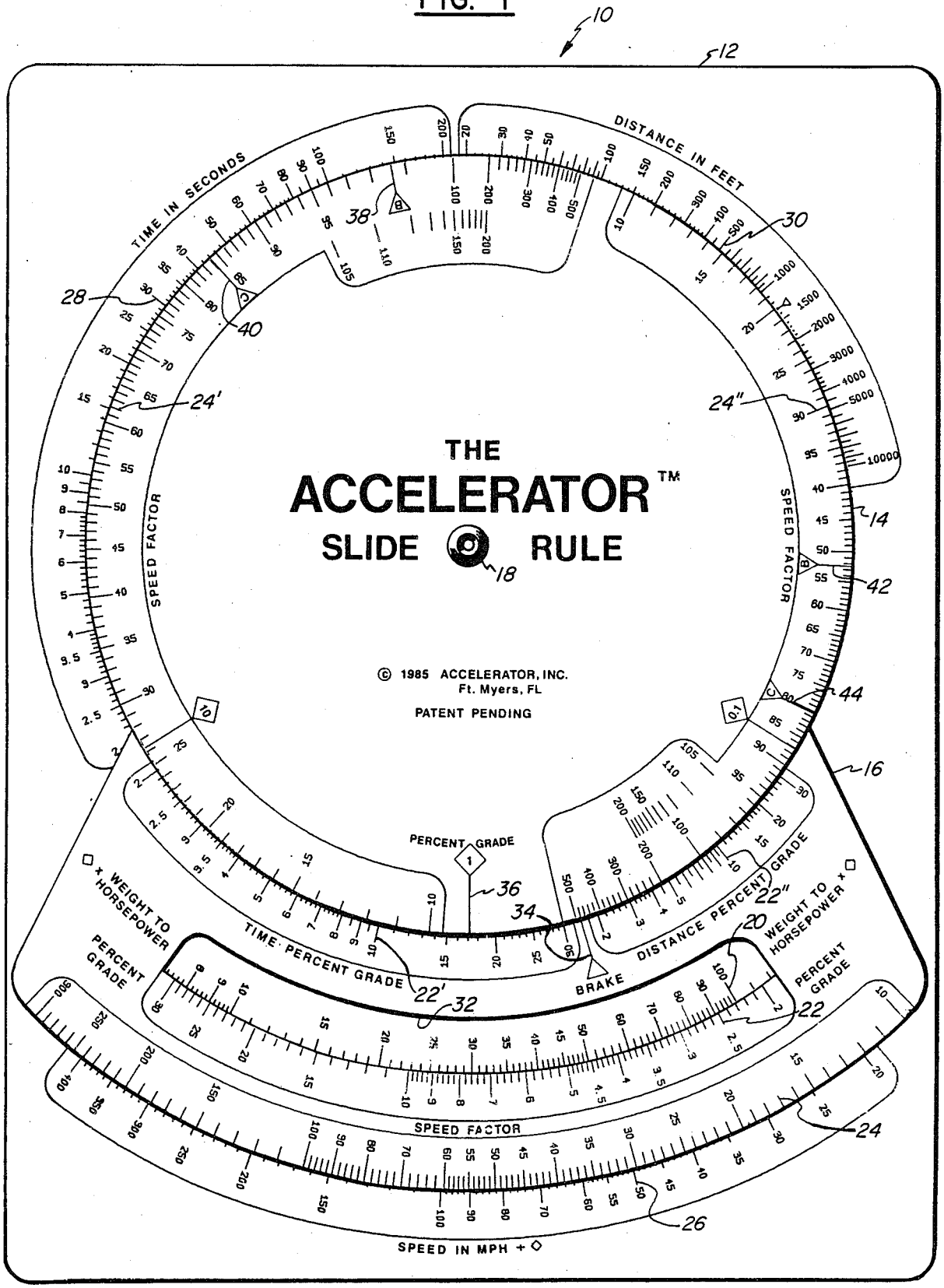
FIG. 1 is a plan view of the preferred embodiment of the invention.

Referring now to the drawings, and particularly to FIGS. 1–4, noting that all values relating to the scales are distinguished from reference characters in the drawings by bracketing all values in quotation (" ") marks, the preferred embodiment of the invention is shown generally at 10 having a generally rectangular-shaped base 12 with a center 46, a generally pie-shaped intermediate slide 16 with a center 48, and a circular top slide 14 with a center 50. The base 12, intermediate slide 16, and top slide 14 are all generally planer and are fabricated of stiff cardboard, plastic or the like. For improved accuracy, all log scales, tick marks and window are impressed into the base 12, intermediate slide 16, and top slide 14 by machine means. Although these components are preferably opaque, they may be fabricated as either translucent or transparent members.

To form the computer 10, intermediate slide 16 is rotatably positioned atop the base 12 and the top slide 14 is rotatably positioned atop the intermediate slide 16. A fastener 18 such as a pop rivet is used to interconnect these members and to provide sufficient friction therebetween to maintain a preset relative position between all members for easy reading and physical management of the various scales one to another.

Figure 2:
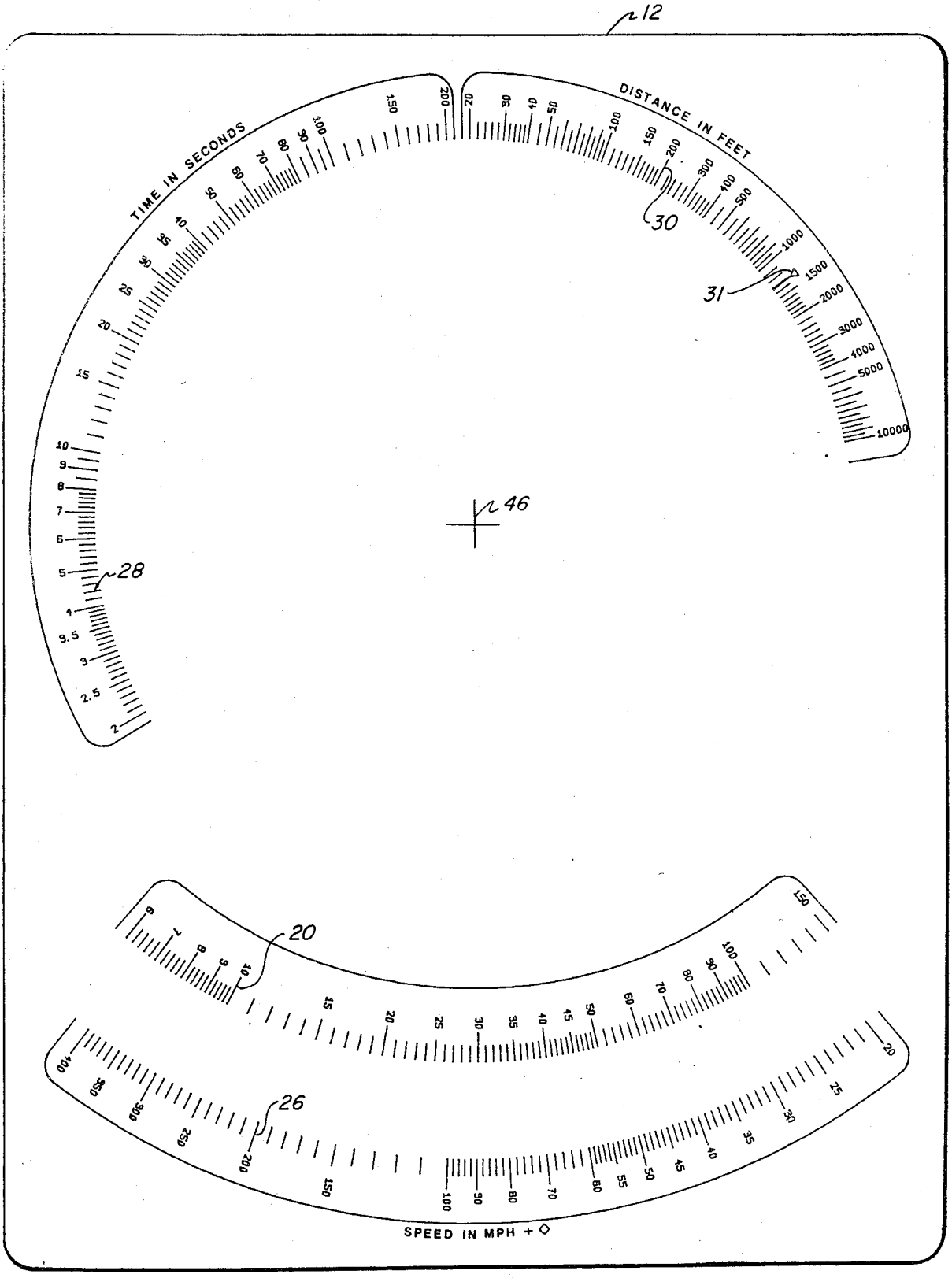
FIG. 2 is a plan view of the base of the invention.

The base 12, as best seen in FIG. 2, includes on its front face arcuately disposed logarithmic scales 20, 26, 28, and 30 about center 46. Log scale 20 has indicia markings thereon representing the ratio of vehicle's total weight to its effective useable horsepower available at the road surface. This ratio will be discussed more fully herebelow. The range of this log scale 20 is from 6 to 150 pounds per horsepower and is in the range suitable for lighter vehicles such as passenger cars, motorcycles and light trucks. Alternately, this log scale 20 has indicia in the range of 100 to 1000 pounds per horsepower and is suitable for use in conjunction with heavy trucks, off-highway haulers and construction equipment.

Disposed concentrically with log scale 20 and outwardly therefrom is log scale 26 having indicia thereon associated with vehicle speed. For smaller vehicles, the range is from °to 400 miles per hour. For the heavier vehicles, the appropriate range is from 3 to 60 miles per hour.

The third scale appearing on the base 12 is the time scale 28 having elapse time indicia for smaller vehicles in the range from 2 to 200 seconds. For heavier vehicles, this scale ranges from 0.01 to 3 minutes. (0.6 to 180 seconds).

The fourth log scale 30 appearing on base 12 is the distance scale having indicia thereon associated with the distance traveled by a vehicle while it alters speed between two particular selected speeds. This scale has a range of from 20 to 10,000 feet for all vehicles, having a tick mark 31 highlighting one quarter mile or 1,320 feet, a frequently referenced value.

Both time and distance log scales 28 and 30 are equally radially disposed from center 46 and are radially closer to the center than log scale 20. This orientation is chosen so that these scales will work in cooperation with the intermediate slide 16 and top slide 14.

Figure 3:
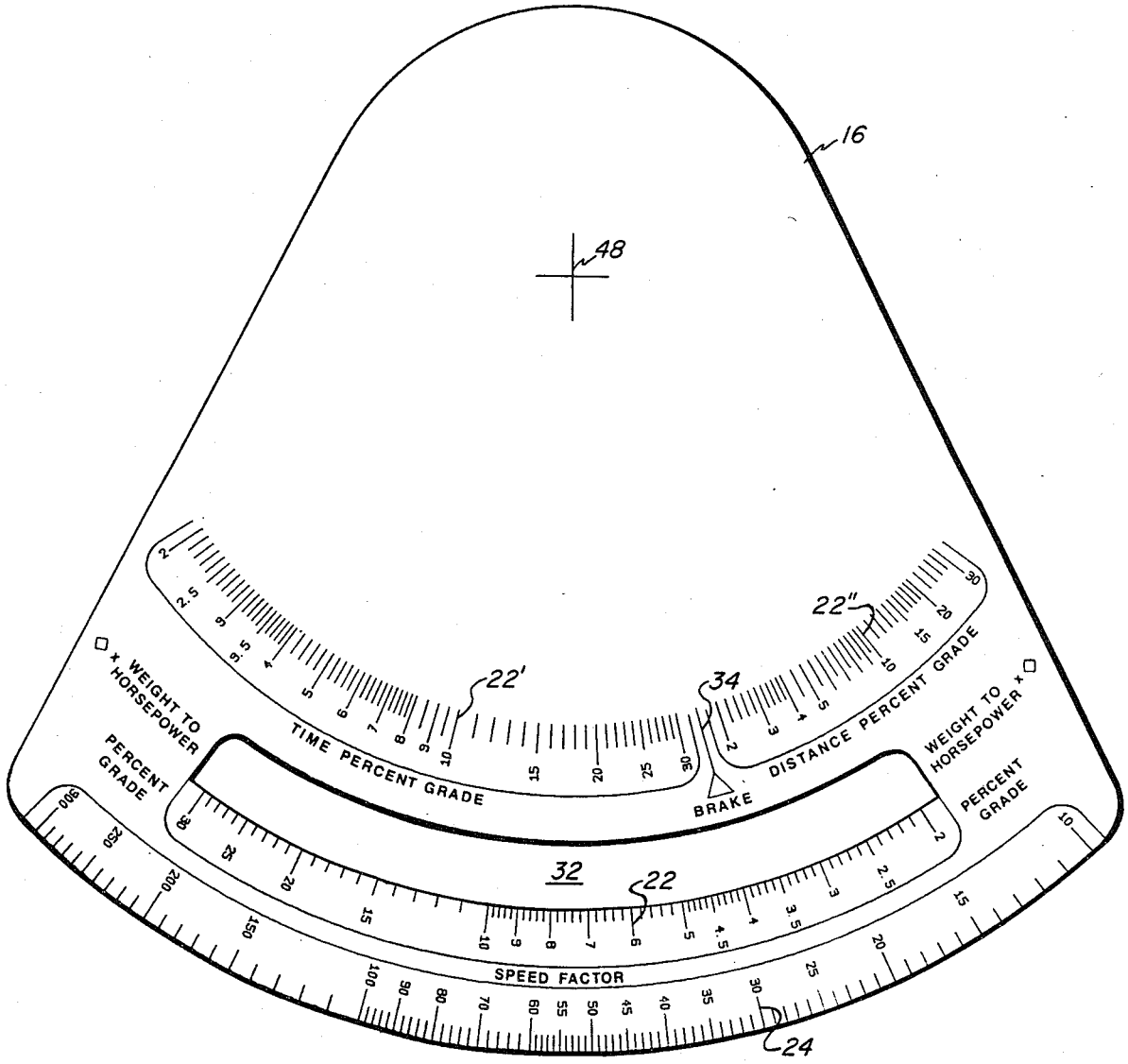
FIG. 3 is a plan view of the intermediate slide of the invention.

As best seen in FIG. 3, the intermediate slide 16 is generally pie-shaped having a center 48 about which arcuate log scales 22, 24, 22' and 22" are disposed. Positioned in relation to log scales 22' and 22" is brake tick mark 34. It should be observed that percent grade log scale 22, time percent grade log scale 22' and distance percent grade log scale 22" all have the same range of indicia. That range for all vehicles is from 2 to 30. Disposed radially inwardly and adjacent to log scale 22 is window 32 through which log scale 20 may be conveniently read.

Figure 4:
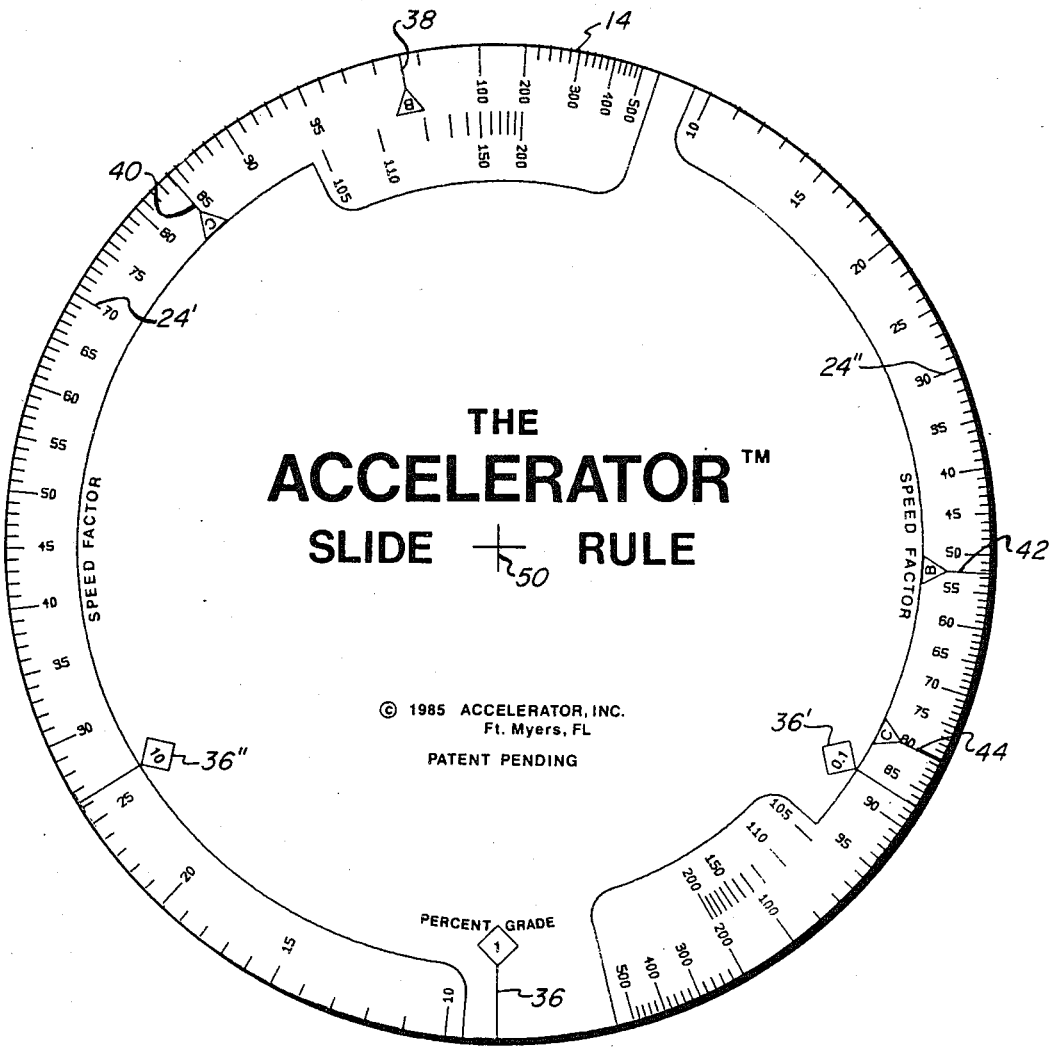
FIG. 4 is a plan view of the top slide of the invention.

Referring particularly to FIG. 4, the top slide 14 is shown therein having arcuately disposed log scales 24' and 24" around center 50. These log scales 24' and 24" are in proportion to the log scale 24 on intermediate slide 16. All of these log scales 24, 24', and 24" are called "speed factor" scales and have indicia thereon representing the vehicle's current speed as a percentage of its stable speed. The stable speed is equal to the maximum attainable steady state speed of the vehicle on a particular percent road grade. For all vehicle classes, there three log scales 24, 24', and 24" have a range of speed factors from 10 to 300 or 500 as shown.

The speed factor log scale 24' is disposed and proportioned on the perimeter of the circular-shaped top slide 14 to be cooperatively viewable in conjunction with the time log scale 28 on base 12. The speed factor scale 24" is disposed and proportionated on the perimeter of top slide 14 so as to be viewable and cooperative with the distance log scale 30 on base 12. Also included on top slide 14 in relation to both speed factor scales 24' and 24" is percent grade tick mark 36. Placed within speed factor scale 24' is a braking time tick mark 38 and a coast time tick mark 40. Within speed factor scale 24' are a braking distance tick mark 42 and a coast distance tick mark 44.

Again, it should be noted that all log scales and/or their ranges are particularly adapted to the size and class of vehicles for which performance is to be predicted. The scales shown in FIGS. 1 through 4 and FIGS. 5 through 7 are adapted for lighter vehicles such as passenger cars, light trucks, motorcycles and the like. It should also be noted that these components, the base 12, the intermediate slide 16 and the top slide 14, and their respective log scales and markings, are dimensioned and configured to scale, both as to one another and as to the markings and indicia thereon. As a result, the user need only cut out or accurately reproduce the drawings in uniform scale and assemble the components in their respective and relative positions rotatably about their centers as shown in FIG. 1 to have a working model of this embodiment of the invention.

DEVELOPMENT OF SCALES

Input Scales

The input data for the present invention includes four variables: weight, horsepower, road grade, and motion resistance.

Vehicle Weight

The weight used should be the actual weight of the vehicle, the sum of its net or curb weight, its payload, and its driver and passengers. Two weight variables are usually provided somewhere in the manufactures name plate or information manual: the net or curb weight and the gross vehicle weight (GVW). The curb weight reflects the net or empty weight of the vehicle. The GVW reflects the maximum total weight that the vehicle is designed to handle, including its curb weight, payload, and passengers. An accurate estimate of the actual total vehicle weight is recommended to enhance accuracy.

Horsepower

The horsepower has many different values for the same vehicle. However, the scales are set forth and utilized in the present invention require an accurate estimate of the horsepower actually available by the drive wheels at the road surface available to propel the vehicle forward. This is sometimes referred to as "effective road horsepower", which may be found in one of two ways. One means for determining the effective road horsepower is from a published rimpull or gradeablity curve for the vehicle. Where a rimpull curve is available showing the driving force that the drive wheels can exert against the road surface, the effective road horsepower equals the rimpull times the speed of the vehicle divided by 375. Alternately, the effective road horsepower may be computed by multiplying the maximum or SAE net brake horsepower by an efficiency factor which is typically in the range of 60 to 90 percent. These losses or reductions in available horsepower to drive the vehicle are as a result of power train and drive train frictional losses and, additionally, as a result of inefficient operational speed of the vehicle's engine. The average horsepower percentage as a result of inefficient engine operation ranges from 65 to 90 percent. As a rule-of-thumb, a percentage effectiveness of 75 percent would be a satisfactory quick estimate before further refinement or study.

Weight-to-Horsepower

The vehicle performance computer 10 utilizes the ratio of total weight to effective road horsepower in conjunction with the indicia on log scale 20. Typical values of weight-to-horsepower range from 0.7 lbs/hp. for top fuel dragsters to 35 to 40 lbs/hp. for a sedan to 650 to 800 lbs/hp. for off highway bottom dump vehicles fully loaded. There may be an occasion when the weight-to-horsepower ratio is beyond either end of the log scale 20. This invention is able to accommodate these situations through the multiplication of the values on the weight-to-horsepower log scale 20 values by 0.1 or 10 as appropriate. This multiplier so used then indicates the proper alternate percent grade tick mark 36' or 36" to use as shown in FIG. 4.

Percent Grade

Indicia associated with the percent grade log scale 22 incorporate the combination of road grade and motion resistance. These values must be positive values, except for situations of coasting down hill. The road grade is the slope or steepness of the road expressed as the rise of the roadway in feet for every 100 feet of horizontal distance. This value is seldom above 12 percent.

There are inherent forces which resist vehicle motion. These motion resistances forces include air resistance, rolling resistance and inertia resistance. These forces must be converted to an equivalent percent grade and added to the road grade to establish the overall percent grade as required for cooperative use in conjunction with log scale 22.

Air resistance is directly proportional to the frontal area that must be pushed through air. At speeds under 30 miles per hour, this value is negligible and does not become significant until the vehicle speed exceeds approximately 70 miles per hour. The range of the air resistance force above 70 miles per hour is typically from 2 to 40 equivalent percent grade dependent on the specific vehicle configuration and attained speed. The significance of air resistance is also directly related to the weight of the vehicle. Therefore, the air resistance, in addition to the overall or equivalent percent grade, is much higher in conjunction with, for example, motorcycles as opposed to heavy off road vehicles.

Rolling resistance is a measure of the force required to overcome the resistance of rolling the tires of the vehicle over the road surface. Softer road surfaces and tires produce higher rolling resistance. For pneumatic tires on a typical concrete highway, the rolling resistance varies with vehicle speed in the range of from 1 to 2 equivalent percent grade. Typical rolling resistance values are as follows:

| Road Surface | Percent Grade |
|---|---|
| Concrete and asphalt | 1.5 |
| Hard packed dirt road, well maintained | 2.0 |
| Medium packed dirt road, fair maintained | 3.3 |
| Soft dirt road with some base, | 4.5 |

-continued

| Road Surface | Percent Grade |
|---|---|
| poor maintained | |
| Rutted and soft dirt road, some use, no base, no maintenance | 8.0 |
| Rutted and spongy dirt track, new path, no base, no maintenance | 18.0 |
| Loose sand and gravel | 10.0 |
| Soft sand | 25.0 |
| Snow, packed | 2.5 |
| Snow, loose | 4.5 |

Inertia resistance is the force required to rotate the moving parts of the vehicle's power train from rest to maximum horsepower speed. Obviously, the first incremental increases in rotational speed result in the highest inertia resistance, in the range of 20 equivalent percent grade, but diminishes to a negligible value. Inertia resistance is also usually proportional to the horsepower of the vehicle.

The total motion resistance, therefore, is the sum of air resistance, rolling resistance and inertia resistance. To simplify the impact of inertia resistance at start-up, assume that the total motion resistance equals 5 percent over the entire speed range up to 70 miles per hour for smaller vehicles. For heavy construction and off-highway vehicles, assume a 2 percent total motion resistance for hard packed road surfaces.

Output Scales

The vehicle performance computer 10 is capable of determining time, distance, and speed for acceleration, deceleration, braking, and coasting, as well as stable speeds for any up-hill road grade.

Stable Speed

When a vehicle accelerates on a particular road grade and surface, it eventually attains a maximum speed at equilibrium known as stable speed, and as represented on log scale 26. Likewise, a stable speed will be attained during deceleration as the vehicle enters onto a higher road grade or more resistant road surface.

Speed Factor

The speed factor as represented in log scales 24, 24' and 24" represents a vehicle's current or present speed as a percentage of its stable speed or maximum attainable speed on a particular road grade and surface. If the stable speed is 100 miles per hour and the current speed is 60 miles, the speed factor is 60. A speed factor of less than 100 indicates additional vehicle acceleration capability. However, where the current vehicle speed is 60 miles per hour and the stable speed is only 40 miles per hour, the speed factor is 150. This indicates a situation where a vehicle has entered a road surface at a speed greater than its stable speed as in entering an uphill grade and will decelerate to its stable speed under those new road conditions.

Time

The time log scale 28 indicates the elapsed time in seconds (or minutes) required for a vehicle to alter speed from one particular current speed to another or to its stable speed. Alternately, the elapsed time during situations of coasting downhill without power applied is frequently of interest.

To more correctly predict total time, the start-up time required to begin vehicle movement will range from 1 to 1.5 seconds for manual transmissions and automatic transmissions respectively. This start-up time value should be added to the predicted time as indicated on the time log scale 28 opposite the coast time tick mark 40.

Distance

The values represented on log scale 30 are the distance traveled in the process of changing vehicle speed from the initial or current speed to either the stable speed, another intended speed, or to zero.

Braking

The vehicle performance computer is able to compute braking distances and times from an initial or current speed to the complete stop of a vehicle. This computation is based upon a braking rate of 0.1 G's or 3.22 feet per second per second. Power train inertia drag and air resistance, as well as road grade, are excluded from this computation assumption. To obtain braking times and distances in relation to higher rates of braking, simply divide the indicated times and distances from log scales 28 and 30 opposite braking time and distance tick marks 38 and 42 by the ratio of "X" G to "0.1" G ("X" G being the higher braking deceleration rate).

Coasting Downhill

The vehicle performance computer 10 is also able to compute the time and distance for the vehicle to coast on a downhill grade from a standstill to a stable speed without power applied as discussed in Examples 6 and 7 herebelow, coasting time and distance tick marks 40 and 44 positioned relative to log scales 24' and 24'' facilitate this function.

EXAMPLES

Figure 5:
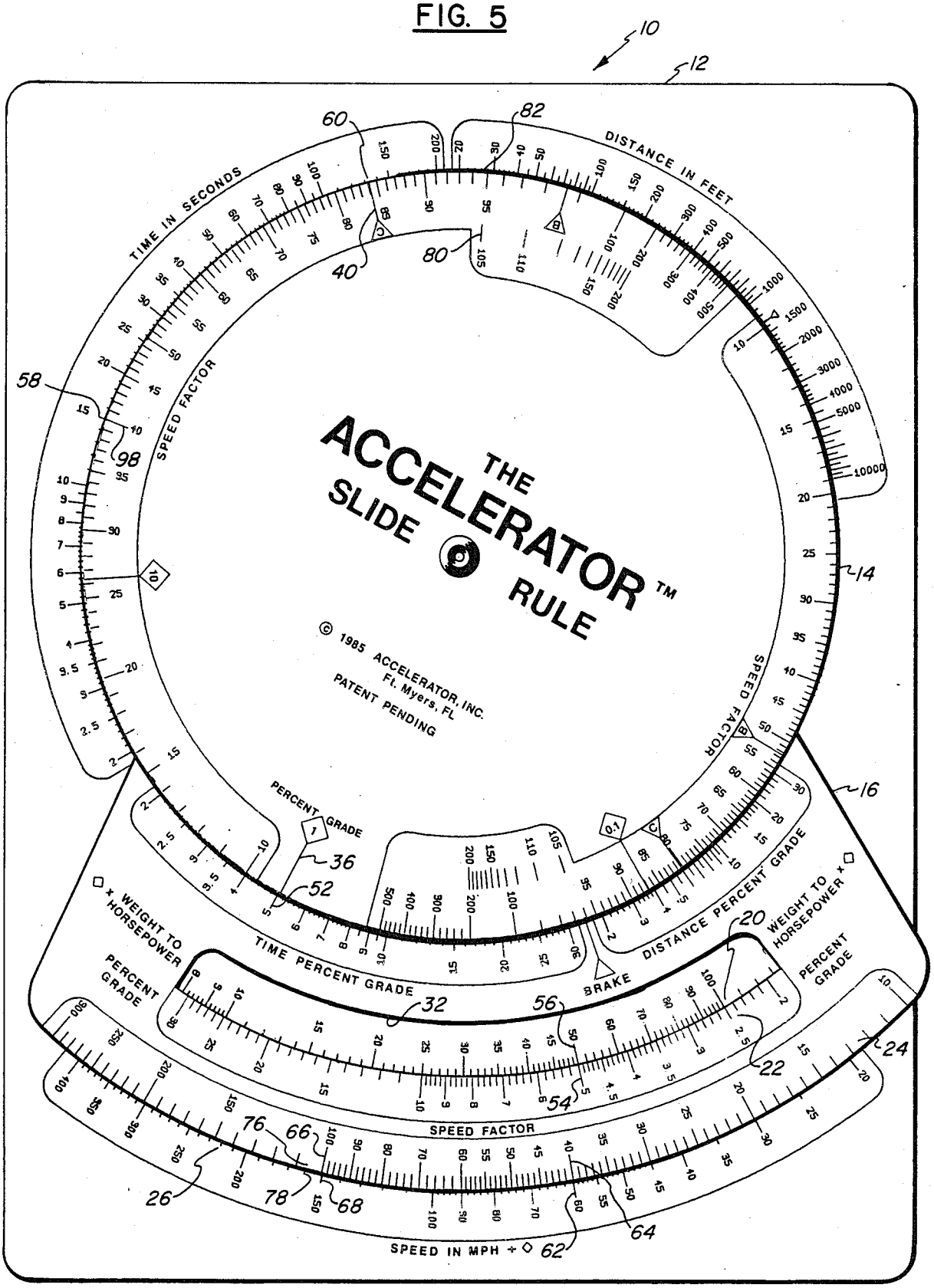
FIG. 5 is a plan view of the invention oriented to determine elapsed time to effect a particular speed change.
Figure 6:
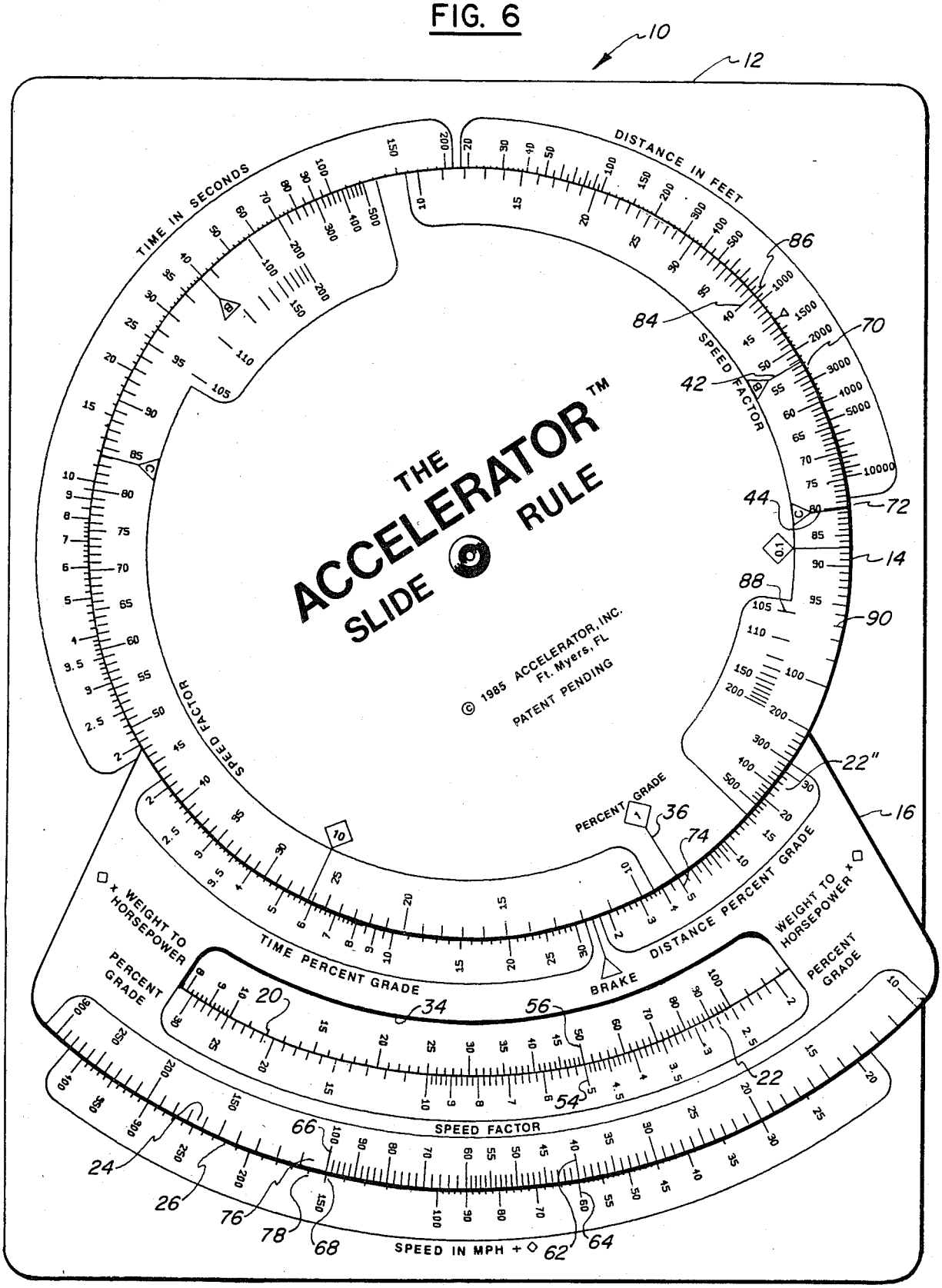
FIG. 6 is a plan view of the invention oriented to determine distance traveled to effect a particular speed change.
Figure 7:
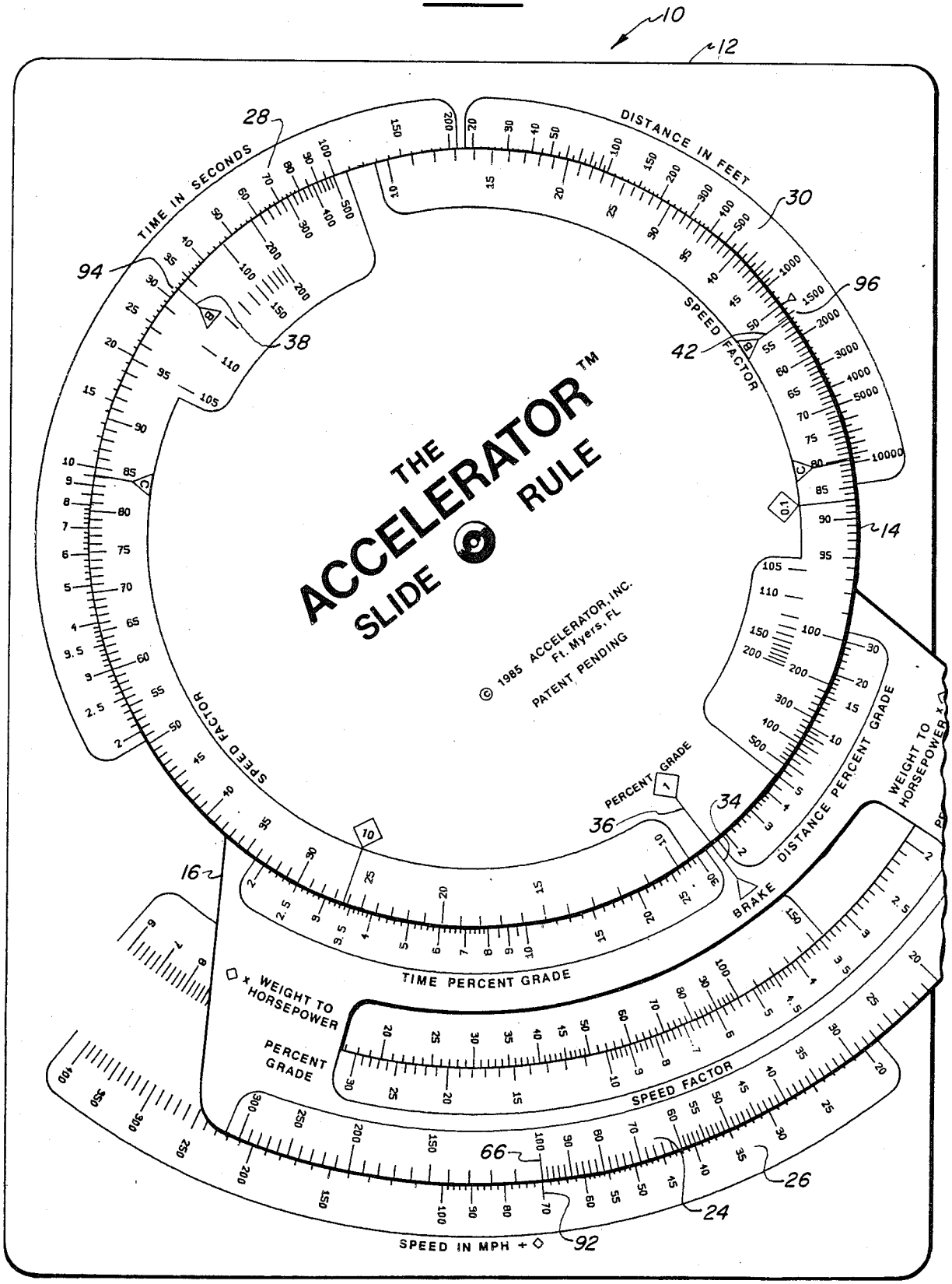
FIG. 7 is a plan view of the invention oriented to determine braking time and distance for an assumed fixed rate of deceleration.

1. Referring now generally to FIGS. 5, 6 and 7, and particularly to FIG. 5, the vehicle performance computer 10 is shown having the intermediate slide 16 and top slide 14 arranged one to another and atop base 12 so as to align the five percent grade mark at 54 with the "50" weight-to-horsepower mark at 56 one to another. To determine the time required to accelerate the vehicle to "60" miles per hour as indicated at numeral 62, the speed factor in conjunction with these settings is "40" as indicated at numeral 64. Then, by aligning the percent grade tick mark 36 with the same percent grade value at 52 on the time percent grade log scale 22' as that indicated on log scale 22 at 54, the time in seconds at numeral 58 is found opposite the "40" speed factor at numeral 98. Note that the "40" speed factor at 98 is the same as that indicated at 62 on log scale 24. Thus, the elapsed time to accelerate this particular vehicle to "60" miles per hour is approximately 15.2 seconds. To more accurately represent the elapsed time in this situation, the start-up time of between 1 and 1.5 seconds should be added to the estimated 15.2 seconds for a total of between 16.2 and 16.7 seconds for this acceleration.

Note that the stable speed is indicated opposite the speed factor of "100" at 66, that stable speed being, "150" miles per hour at numeral 68. Frequently, as here, the vehicle performance computer will indicate stable speeds far in excess of a vehicle's top speed capability. These excessive readings normally occur when the percent grade setting is for motion resistances in the zero to "70" mile per hour range. The excessively high stable speed reading is based upon an air resistance value typical of lower speeds, which is unrealistic.

2. Referring to FIG. 6, the vehicle performance computer is shown positioned to determine the distance traveled under the same percent grade conditions at in the previous example, "5" as indicated at numeral 54 in conjunction with "50" weight-to-horsepower at numeral 56. Again, taking the desired speed to be "60" miles per hour as indicated at numeral 64, the associated speed factor of "40" is indicated at numeral 64. After aligning the percent grade tick mark 36 with the value "5" on the distance percent grade scale 22'' at numeral 74, the distance traveled for this acceleration is indicated opposite the value "40" speed factor at numeral 84. This distance is approximately 930 feet as indicated at numeral 86.

3. To determine deceleration time from an initial speed down to the stable speed of the vehicle, referring again to FIG. 5, first align the appropriate weight-to-horsepower value at numeral 56, with the appropriate percent grade value at numeral 54 one to another. Align the percent grade tick mark 36 with the same percent grade value at numeral 52. Thereafter, read the speed factor on scale 26, here at numeral 76, opposite the initial speed, here, "160" miles per hour at numeral 78. The speed factor for this example is "105". Note that this particular function requires an initial speed in excess of the speed opposite the "100" mark at numeral 66. Thereafter, read the elapsed time for this deceleration opposite the same "105" speed factor, here at numeral 80. Speed factors between "105" and "200" must be extended visually or with the aid of a straight edge to read the opposing time value, which, in this example is "270" seconds on the time log scale 28.

4. To determine the distance traveled in the previous example, again referring to FIG. 6 and having the weight-to-horsepower value at 56 aligned with the percent grade at 54, position the percent grade tick mark 36 opposite the same distance percent grade value "5" at 74 on log scale 22''. Thereafter, again read the indicated speed factor "105" at 76 opposite the initial speed of "160" miles per hour at 78. The distance traveled during this deceleration will be indicated opposite the same speed factor as at 88. Again, speed factors between 105 and 200 must be extended visually or with the aid of a straight edge to read the distance value, which in this example is about "55,000" feet on log scale 30.

Where a value to be read is substantially beyond the end of that log scale, as in this example, it is recommended that less reliance be placed on that value. In fact, the overall input parameters should be reexamined to determine if they are realistic to overall value. In Example 6, the stable speed of "150" miles per hour at 68 is, in the first instance, unrealistic because based upon a percent grade value of "5" at 74 which includes motion resistance values for much lower speeds as previously discussed. Empirical refinement of this percent grade value upward will have the obvious double effect of reducing the speed value on log scale 26 opposite the "100" speed factor at 66 and of moving the percent grade tick mark 36 and top slide 14 rationally counterclockwise as viewed in FIG. 6. Thus, the speed factor value "105" at 88 will then be within the directly readable range of the distance log scale 30.

5. To determine the braking time and distance values resulting from braking the vehicle from a beginning or initial speed down to a complete stop, referring to FIG. 7, set the "100" speed factor value as indicated at 6 on log scale 24 opposite the beginning speed of 70 miles per hour for this example as indicated at 92 on log scale 26.

Thereafter, align the percent grade tick mark 36 with the brake tick mark 34. The time required for this deceleration, then, will be indicated on log scale 28 opposite the brake tick mark 38 at 94, that time being approximately 31.9 seconds. To determine the distance traveled during this same deceleration, read the distance value at 96 on log scale 30 opposite the braking distance tick mark 42. That distance value is approximately 1650 feet.

Note that, as previously discussed, this computation is based upon a braking rate of 0.1 G's or 3.22 feet per second per second. Other deceleration rates may be accommodated.

6. The vehicle performance computer can also calculate the downhill coasting time elapsed while a vehicle moves from a standstill to a desired final speed down a particular grade. Referring again to FIG. 5, set the "100" speed factor at 66 opposite the desired final speed, "150" miles per hour at 68. (Note that this is the exaggerated stable speed in conjunction with Example 1 for this same vehicle.) The percent grade tick mark 36 is then set opposite the time percent grade value at 52 which corresponds to the net downhill percent grade equal to the positive motion resistance value less the negative road grade, producing a negative number. The elapsed time for this coasting condition is indicated opposite the coast time tick mark 40 at 60, that time being "136" seconds.

7. To determine the coasting distance for the previous example, referring to FIG. 6 and having aligned the "100" speed factor at 66 opposite the final speed at 68, align the percent grade tick mark 36 opposite the same distance percent grade value at 74. Thereafter, read the distance traveled opposite the coast distance tick mark 44 at 72, that value being approximately "14,500" based upon the previously discussed technique of estimating "off-scale" values.

WORKING BACKWARDS

The vehicle performance computer may also be used to "work backward" from actual data points of time, distance, and/or speed to obtain more accurate values for percent grade, weight-to-horsepower, or start-up time estimates. From just one performance statistic, such as the acceleration time from zero to 60 miles per hour, the percent grade estimate can be refined to more accurately reflect the vehicle's motion resistance. Two performance times, such as the acceleration times from zero to 30 miles and zero to 70 miles per hour enable the refinement of the weight-to-horsepower ratio and start-up time estimates.

The objective in working backwards in refining these estimates of vehicle characteristics is to enable more accurate estimates of the subsequent vehicle performance when encountering different road grades and road surfaces. Further, during the life of a vehicle, engine horsepower output may be estimated and monitored for wear and performance degradation. In other words, the vehicle performance computer provides an easy and convenient way to get realistic "dynamometer-type" studies relative to horsepower-to-road horsepower available.

Referring back to the manipulation and read-out methods previously discussed, it should be now obvious to the reader that the following situations lend themselves to "working backwards":

1. Where percent grade, weight-to-horsepower and time are known, the accurate speed factor and speed may be read.

2. Where percent grade, weight-to-horsepower and distance are known, the accurate speed factor and speed in miles per hour may be read.

3. Where time, speed and weight-to-horsepower are known, utilizing repeated settings of percent grade and then by comparing the indicated time opposite each speed factor for each new estimated percent grade with the actual time, the effective percent grade may be found.

4. Where distance, speed and weight-to-horsepower are known, by repeated estimates and settings of percent grade and comparison of the predicted distance opposite each speed factor associated with each estimate with the actual distance, the effective percent grade may be found.

5. Where time, speed and percent grade are known, by repeated estimate of weight-to-horsepower and comparison of the predicted time associated with each estimate opposite the corresponding speed factor with the actual time, the effective weight-to-horsepower ratio may be found.

6. Where distance, speed, and percent grade are known, by repeated estimate of the weight-to-horsepower and comparison of the predicted distance associated with each estimate opposite the corresponding speed factor with the actual distance, the effective weight-to-horsepower rates may be found.

At this point, the reader should be in a position to further enhance this catagorization of "working back" situations to develop further uses for the vehicle performance computer.

Note again, that for clarity throughout this portion of the specification, numerical parameter values have been distinguished and set off by quotation marks as opposed to numerical reference characters.

While the instant invention has been shown and described herein in what is conceived to be the most practical and preferred embodiment, it is recognized that departures may be made therefrom within the scope of this invention, which is therefore not to be limited to the details disclosed herein, but is to be accorded the full scope of the claims so as to embrace any and all equivalent apparatus and articles.

I claim:

1. A vehicle performance computer in the form of a circular slide rule for determining the relationship between the vehicle performance parameters of time, distance, braking, coasting, and acceleration as a function of vehicle weight, horsepower, speed, and roadway percent grade, said computer comprising:

substantially planar base having a center and also including:

a first logarithmic scale arcuately disposed about said base center and having indicia associated therewith representing the speed of the vehicle;

a second logarithmic scale arcuately disposed about said base center in a predetermined position with respect to said first logarithmic scale and having indicia associated therewith representing the weight-to-horsepower of the vehicle;

a third logarithmic scale arcuately disposed about said base center in a predetermined position with respect to said first and second logarithmic scales and having indicia associated therewith representing the required time for the vehicle to alter its speed from one particular speed to another;

a substantially planar intermediate slide having a center and rotatably mounted atop said base whereby both said centers are aligned, said intermediate slide including:

a fourth logarithmic scale arcuately disposed about said intermediate slide center and having indicia associated therewith representing the percent grade upon which the vehicle is traveling;

a window arcuately disposed about said intermediate slide center in a predetermined position with respect to said fourth logarithmic scale for viewing said second logarithmic scale therethrough in cooperative viewable alignment with said fourth logarithmic scale;

a fifth logarithmic scale arcuately disposed about said intermediate slide center in a predetermined position with respect to said fourth logarithmic scale in cooperative viewable alignment with said first logarithmic scale and having indicia associated therewith representing the speed factor of the vehicle as a percent of the maximum attainable stable vehicle speed in relation to a particular current vehicle speed on a particular percent grade;

a sixth logarithmic scale arcuately disposed about said intermediate slide center in a predetermined position with respect to said fourth and fifth logarithmic scales and having indicia associated therewith representing time percent grade in proportion to said fourth lagarithmic scale;

a brake tick mark disposed in a particular position to said sixth lagarithmic scale;

a substantially planar circular top slide having a center and rotatably mounted atop said intermediate slide whereby all three said centers are aligned, said top slide including:

a seventh logarithmic scale arcuately disposed about said top slide center in cooperative viewable alignment with said sixth logarithmic scale and said brake tick mark and having indicia associated therewith representing said speed factor;

a first percent grade tick mark disposed in a particular position with respect to said seventh logarithmic scale in cooperative viewable alignment with said sixth logarithmic scale and said brake tick mark;

a braking time tick mark disposed in a particular position with respect to said seventh logarithmic scale and in cooperative viewable alignment with said third logarithmic scale for indicating on said third logarithmic scale a particular required time for the vehicle to brake to a particular speed;

a coast time tick mark disposed in a particular position with respect to said seventh logarithmic scale and in cooperative viewable alignment with said third logarithmic scale for indicating on said third logarithmic scale a particular required time for the vehicle to coast to a particular speed.

2. A vehicle performance computer as set forth in claim 1, wherein:

said planar base further includes:

an eighth logarithmic scale arcuately disposed about said base center in a predetermined position with respect to said first and second logarithmic scales and having indicia associated therewith representing the distance traveled by the vehicle while altering its speed from one particular speed to another;

said intermediate slide further includes:

a ninth logarithmic scale arcuately disposed about said intermediate slide center in a predetermined position with respect to said fourth and fifth logarithmic scales and having indicia associated therewith representing distance percent grade in proportion to said fourth logarithmic scale;

said top slide further includes:

a tenth logarithmic scale arcuately disposed about said top slide center in cooperative viewable alignment with said eighth logarithmic scale having indicia associated therewith representing said speed factor;

said percent grade tick mark also disposed in a particular position with respect to said tenth logarithmic scale in cooperative viewable alignment with said ninth logarithmic scale;

a braking distance tick mark disposed in a particular position with respect to said tenth logarithmic scale and in cooperative viewable alignment with said eight logarithmic scale for indicating on said eighth logarithmic scale a particular required distance for the vehicle to brake to a particular speed;

a coast distance tick mark disposed in a particular position with respect to said tenth logarithmic scale and in cooperative viewable alignment with said eighth logarithmic scale for indicating on said eighth logarithmic scale a particular required distance for the vehicle to coast to a particular speed.

3. A vehicle performance computer as set forth in claim 2, wherein:

said first logarithmic scale is concentric with and radially outward from said second logarithmic scale;

said sixth and ninth logarithmic scale are concentric with and radially equidistant from said base center and concentric with and radially inward from said fourth logarithmic scale;

said window is concentric with and radially inward from said fourth logarithmic scale;

said fourth scale is concentric with and radially inward from said fifth logarithmic scale;

said seventh and tenth logarithmic scale are concentric with and radially equidistant from said second slide center.

4. A vehicle performance computer as set forth in claim 3, wherein:

said base is rectangular;

said first slide is generally wedge-shaped;

said second slide is circular.

5. A vehicle performance computer as set forth in claim 3, wherein:

all said scales are adapted for vehicles which are passenger cars, motorcycles and light trucks.

6. A vehicle performance computer as set forth in claim 3, wherein:

all said scales are adapted for vehicles which are heavy trucks, off-highway haulers, and construction equipment.

7. A vehicle performance computer as set forth in claim 3, wherein:

said fourth logarithmic scale is adapted to include road grade, motion resistance, and air resistance, tire rolling resistance, and power train intertia resistance.

8. A vehicle performance computer in the form of a circular slide rule for determining the relationship between the vehicle performance paramters of time, distance, braking, coasting, and acceleration as a function of vehicle weight, horsepower, speed, and roadway percent grade, said computer comprising:

a substantially planer base having a center and also including:

a first logarithmic scale arcuately disposed about said base center and having indicia associated therewith representing the speed of the vehicle;

a second logarithmic scale arcuately disposed about said base center in a predetermined position with respect to said first logarithmic scale and having indicia associated therewith representing the weight-to-horsepower of the vehicle;

eighth logarithmic scale arcuately disposed about said base center in a predetermined position with respect to said first and second logarithmic scales and having indicia associated therewith representing the distance traveled by the vehicle while altering its speed from one particular speed to another;

a substantially planer intermediate slide having a center and rotatably mounted atop said base whereby both said centers are aligned, said intermediate slide including;

a fourth logarithmic scale arcuately disposed about said intermediate slide center and having indicia associated therewith representing the percent grade upon which the vehicle is traveling;

a window arcuately disposed about said intermediate scale center in a predetermined position with respect to said fourth logarithmic scale for viewing said second logarithmic scale therethrough in cooperative viewable alignment with said fourth logarithmic scale;

a fifth logarithmic scale arcuately disposed about said intermediate slide center in a predetermined position with respect to said fourth logarithmic scale in cooperative viewable alignment with said first logarithmic scale and having indicia associated therewith representing the speed factor of the vehicle as a percent of the maximum attainable stable vehicle speed in relation to a particular current vehicle speed on a particular percent grade;

a ninth logarithmic scale arcuately disposed about said intermediate slide center in a predetermined position with respect to said fourth and fifth logarithmic scales and having indicia associated therewith representing distance percent grade in proportion to said fourth logarithmic scale;

a brake tick mark disposed in a particular position to said ninth logarithmic scale;

a substantially planer circular top slide having a center and rotatably mounted atop said intermediate slide whereby all three said centers are aligned, said top slide including;

a tenth logarithmic scale arcuately disposed about said top slide center in cooperative viewable alignment with said eighth logarithmic scale and said brake tick mark and having indicia associated therewith representing said speed factor;

a percent grade tick mark disposed in a particular position with respect to said tenth logarithmic scale in cooperative viewable alignment with said ninth logarithmic scale and said brake tick mark;

a braking distance tick mark disposed in a particular position with respect to said tenth logarithmic scale and in cooperative viewable alignment with said eighth logarithmic scale for indicating on said eighth logarithmic scale a particular required distance for the vehicle to brake to a particular speed;

a coast distance tick mark disposed in a particular position with respect to said tenth logarithmic scale and in cooperative viewable alignment with said eighth logarithmic scale for indicating on said eighth logarithmic scale a particular required distance for the vehicle to coast to a particular speed.

9. A vehicle performance computer as set forth in claim 8, wherein:

said first logarithmic scale is concentric with and radially outward from said second logarithmic scale;

said ninth logarithmic scale is concentric with and radially inward from said fourth logarithmic scale;

said window is concentric with and radially inward from said fourth logarithmic scale;

said fourth scale is concentric with and radially inward from said fifth logarithmic scale;

said tenth logarithmic scale is concentric with said top slide center.

10. A vehicle performance computer as set forth in claim 9, wherein:

said base is rectangular;

said first slide is generally wedge-shaped;

said second slide is circular.

11. A vehicle performance computer as set forth in claim 9, wherein:

all said scales are adapted for vehicles which are passenger cars, motorcycles and light trucks.

12. A vehicle performance computer as set forth in claim 9, wherein:

all said scales are adapted for vehicles which are heavy trucks, off-highway haulers, and construction equipment.

13. A vehicle performance computer as set forth in claim 9, wherein:

said fourth logarithmic scale is adapted to include road grade, motion resistance, and air resistance, tire rolling resistance, and power train intertia resistance.

* * * * *